US007364479B1

(12) United States Patent
Deily

(10) Patent No.: US 7,364,479 B1
(45) Date of Patent: Apr. 29, 2008

(54) CRIMP CONNECTOR FOR CONNECTING A CONDUCTOR CABLE AND ELECTRODE OF AN IMPLANTABLE CARDIAC ELECTROTHERAPY LEAD

(75) Inventor: David Deily, Chatsworth, CA (US)

(73) Assignee: Pacesetter, Inc., Sylmar, CA (US)

( * ) Notice: Subject to any disclaimer, the term of this patent is extended or adjusted under 35 U.S.C. 154(b) by 0 days.

(21) Appl. No.: 11/670,948

(22) Filed: Feb. 2, 2007

(51) Int. Cl.
*H01R 4/10* (2006.01)

(52) U.S. Cl. ..... 439/879; 439/909

(58) Field of Classification Search ..... 439/587, 439/909, 578, 442, 877–879, 579–586; 607/37–38, 607/122, 115, 116, 119; 600/373–381
See application file for complete search history.

(56) References Cited

U.S. PATENT DOCUMENTS 3,412,366 A * 11/1968 Pittman, Jr. ..... 439/278
3,514,528 A * 5/1970 Ray ..... 174/84 C
3,831,132 A * 8/1974 Bowden et al. ..... 439/442
7,108,549 B2 * 9/2006 Lyu et al. ..... 439/587

* cited by examiner

*Primary Examiner*—Edwin A. Leon

(57) ABSTRACT

Disclosed herein is a crimp connector for connecting to at least one cable conductor of an implantable cardiac electrotherapy lead. The crimp connector includes a thin-walled body, which has an outer surface, an inner surface, proximal and distal edges, a cavity, and a tab. The inner surface defines the cavity. The proximal and distal edges respectively define proximal and distal openings leading to the cavity. The tab projects outwardly from and extends along the outer surface in a direction generally transverse to an axis extending between the proximal and distal openings.

11 Claims, 5 Drawing Sheets

FIG. 3
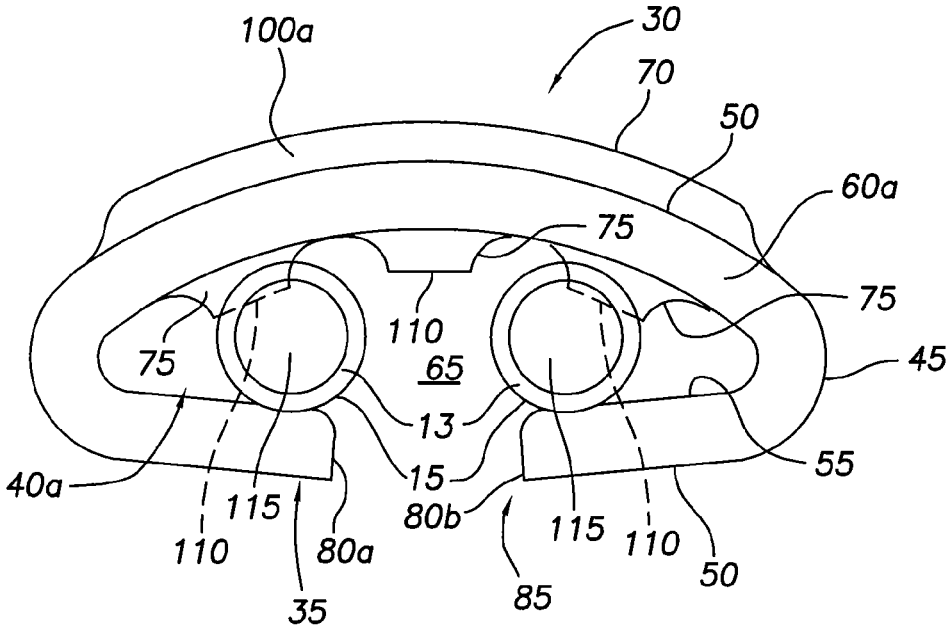
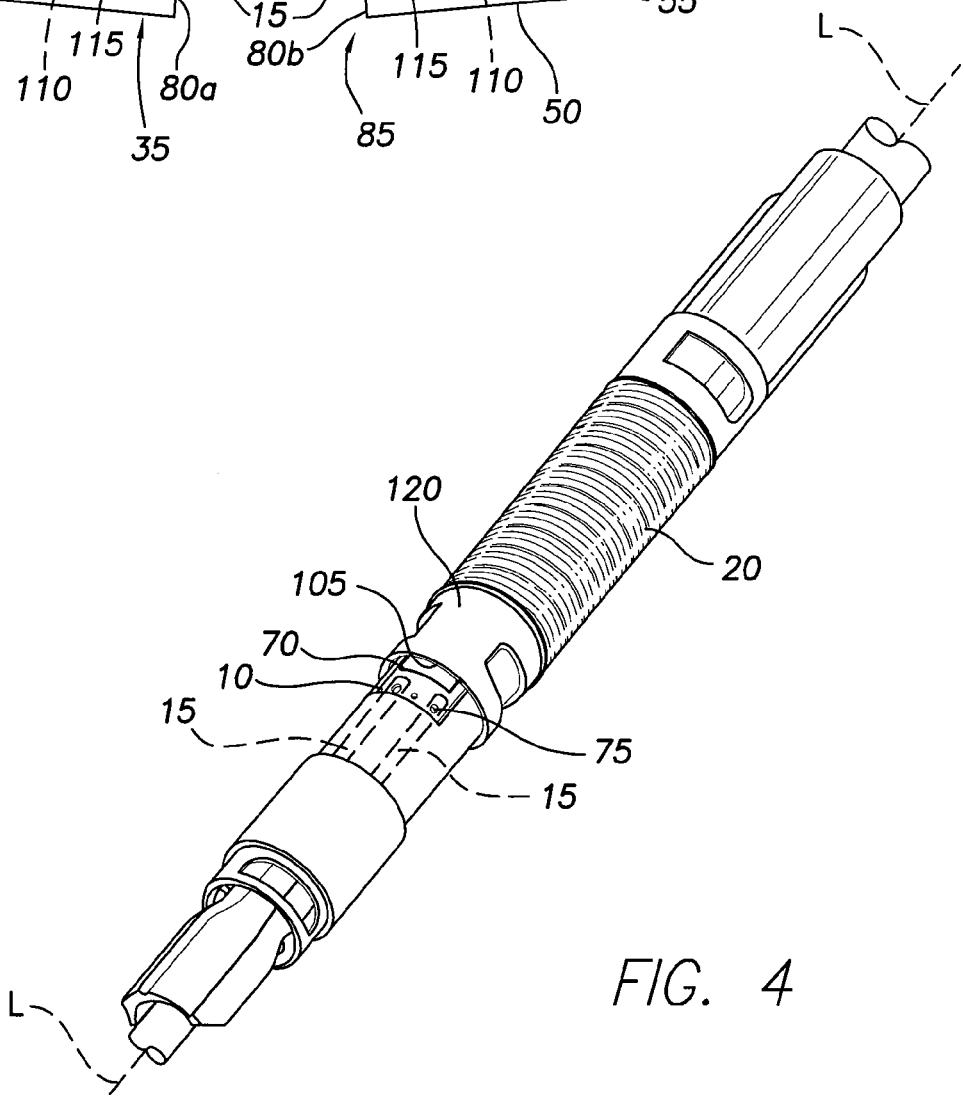
FIG. 4

CRIMP CONNECTOR FOR CONNECTING A CONDUCTOR CABLE AND ELECTRODE OF AN IMPLANTABLE CARDIAC ELECTROTHERAPY LEAD

FIELD OF THE INVENTION

The present invention relates to medical apparatus and methods of manufacturing such apparatus. More specifically, the present invention relates to implantable cardiac electrotherapy leads and methods of manufacturing such leads.

BACKGROUND OF THE INVENTION

Current implantable cardiac electrotherapy leads (e.g., cardiac resynchronization therapy ("CRT") leads, bradycardia leads, tachycardia leads) utilize crimp connectors to transition from conductor cables to welded joints at the electrodes or shock coils. Such transitions are excessively expensive to create for a number of reasons. First, each transition employs a relatively expensive crimp connector individually cut using a wire EDM process.

Second, the process for creating the transition is labor intensive. To achieve adequate electrical contact between a crimp connector and the conductive core of a cable conductor, insulation must be removed from the cable conductor where the crimp connector will be crimped onto the cable conductor.

Third, difficulty associated with the process of creating the transition results in substantial scrap. The crimp connector is unidirectional and is often reversed when crimped onto the cable conductor, resulting in the scrapping of the crimp connector and the cable conductor. The configuration of the in crimp connector requires relatively tight tolerances for fit and placement of the crimp connector relative to shock coil when undergoing welding. Failure to satisfy the tight tolerances can result in a weak weld between the crimp connector and the shock coil, or welding can burn a hole through the connector and scrap the lead.

There is a need in the art for a crimp connector that reduces the costs associated connecting a cable conductor to a lead shock coil. There is also a need in the art for a method of employing such a crimp connector in connecting a cable conductor to a lead shock coil.

SUMMARY

Disclosed herein is a crimp connector for connecting to at least one cable conductor of an implantable cardiac electrotherapy lead. In one embodiment, the crimp connector includes a thin-walled body, which has an outer surface, an inner surface, proximal and distal edges, a cavity, and a tab. The inner surface defines the cavity. The proximal and distal edges respectively define proximal and distal openings leading to the cavity. The tab projects outwardly from and extends along the outer surface in a direction generally transverse to an axis extending between the proximal and distal openings.

Disclosed herein is a crimp connector for connecting to at least one cable conductor of an implantable cardiac electrotherapy lead. In one embodiment, the crimp connector includes a thin-walled body, which has an outer surface, an inner surface, proximal and distal edges, a cavity, and at least one protrusion. The inner surface defines the cavity. The proximal and distal edges respectively define proximal and distal openings leading to the cavity. The at least one protrusion extends into the cavity from the inner surface.

An implantable cardiac electrotherapy lead is disclosed herein. In one embodiment, the lead includes a tubular body, an electrode, a cable conductor, and a crimp connector. The electrode is located on the tubular body and includes a feature extending generally transverse to a longitudinal axis of the tubular body. The cable conductor includes an end. The crimp connector includes a tab, a cavity, and a protrusion. The tab extends outwardly from the crimp connector and the cavity receives the end of the cable conductor. The protrusion extends into the cavity and through an insulation layer of the cable conductor to electrically contact a conductive core of the cable conductor. The tab extends generally transverse to the longitudinal axis of the tubular body and abuts against and is welded to the feature of the electrode.

A method of manufacturing an implantable cardiac electrotherapy lead is disclosed herein. In one embodiment, the method includes providing an electrode on a tubular body of the lead, receiving an end of a cable conductor in a cavity of a crimp connector, welding a tab of a crimp connector to a feature of the electrode extending generally transverse to a longitudinal axis of the tubular body, and causing a protrusion of the crimp connector to penetrate an insulation layer of the cable conductor to place the protrusion in electrical contact with a conductive core of the cable conductor.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

BRIEF DESCRIPTION OF THE DRAWINGS

FIG. 3 is an elevation of an end opening of the crimp connector.

FIG. 4 is an isometric view of a lead with the crimp connector connected to the electrode.

DETAILED DESCRIPTION

Figure 1:
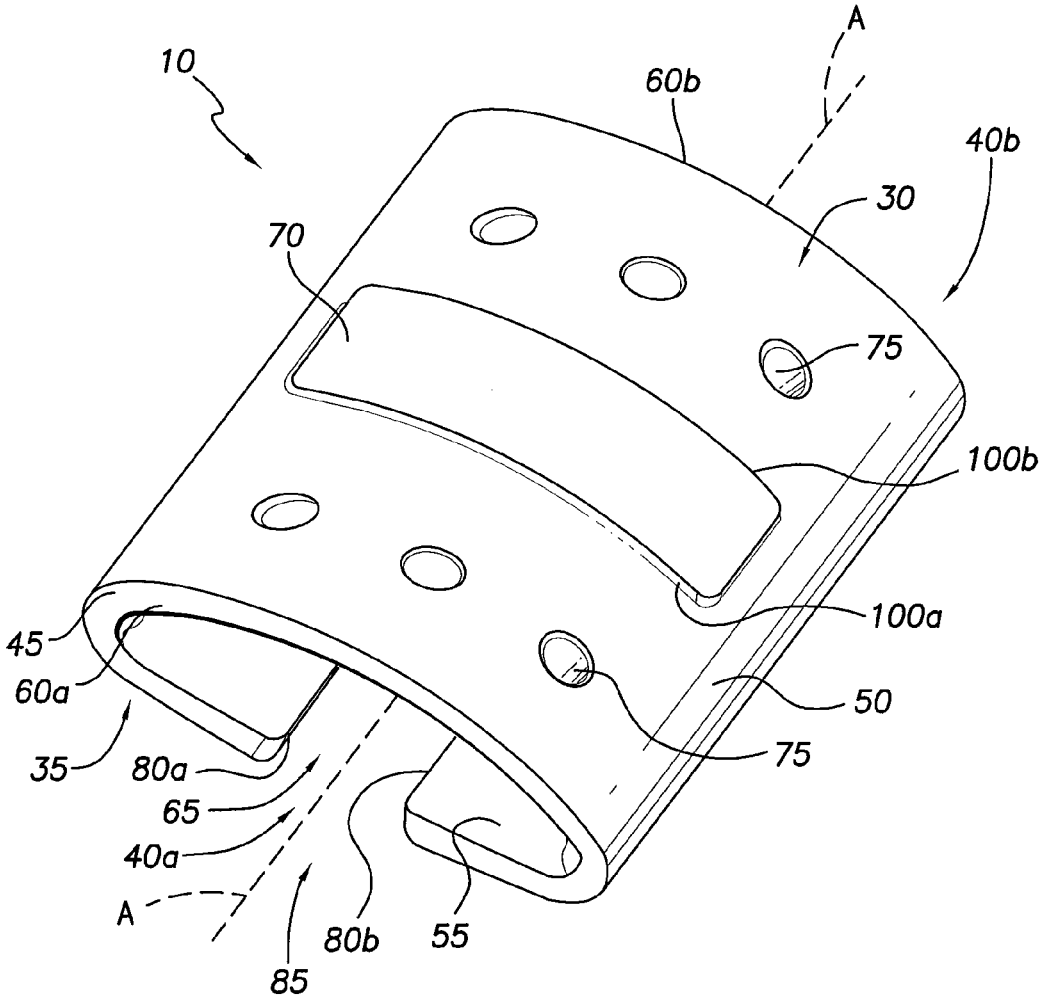
FIG. 1 is an isometric view of the outward-facing side of the crimp connector.

A crimp connector 10 for connecting a cable conductor 15 and electrode (e.g., pacing electrode, sensing electrode, or shock electrode or coil) 20 of an implantable cardiac electrotherapy lead 25 is disclosed herein. The crimp connector 10 is bi-directional, does not require removal (e.g., ablation) of cable conductor insulation 13 prior to connecting the crimp connector 10 to the cable conductor 15, and is manufactured via a less expensive progressive stamping process. Additionally, the crimp connector 10 offers improved welding strength and reduced welding difficulty. Accordingly, the crimp connector 10 substantially reduces manufacturing cost associated with connecting cable conductors 15 to the electrodes 20 of implantable cardiac electrotherapy leads 25.

Figure 2:
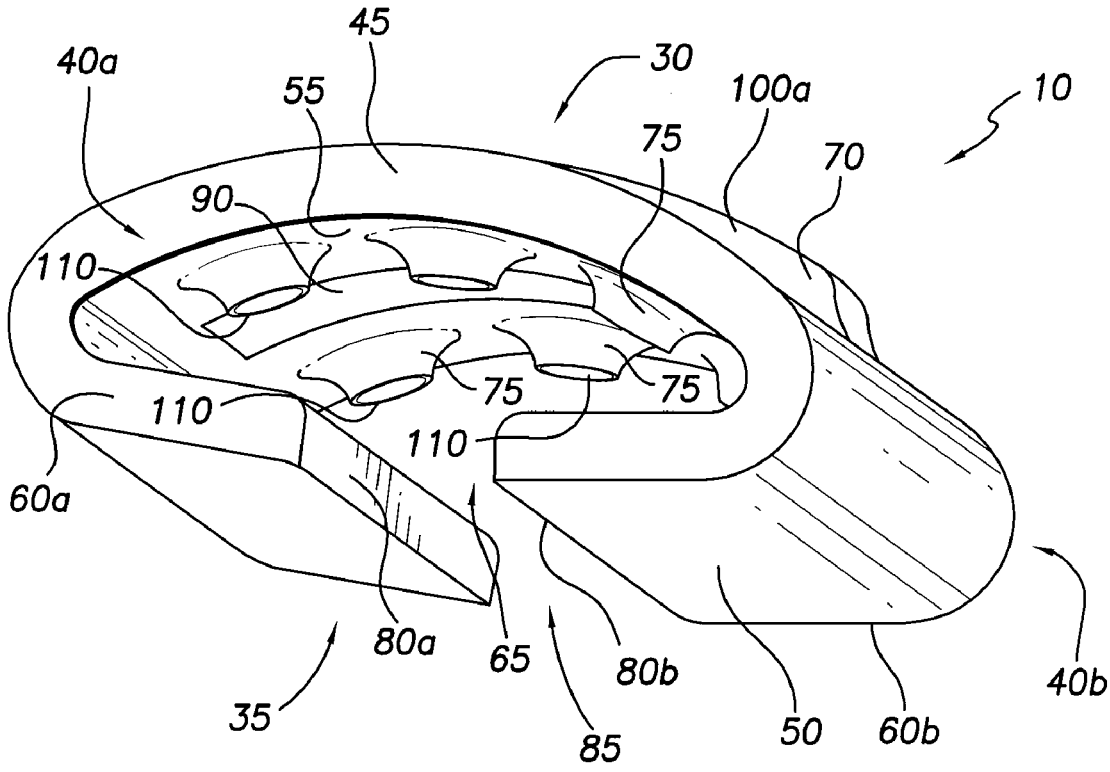
FIG. 2 is an isometric view of the inward-facing side of the crimp connector.

For a discussion regarding the crimp connector 10, reference is made to FIGS. 1-3. FIG. 1 is an isometric view of the outward-facing side 30 of the crimp connector 10. FIG. 2 is an isometric view of the inward-facing side 35 of the crimp connector 10. FIG. 3 is an elevation of an end opening 40*a* of the crimp connector 10.

As can be understood from FIGS. 1-3, in one embodiment, the crimp connector 10 is a generally planar strip or wall 45 formed into a thin-wall body 10. The wall 45 or body 10 has an outer surface 50, an inner surface 55, proximal and distal edges 60*a*, 60*b*, a cavity 65, a tab 70, protrusions 75, and opposed ends 80*a*, 80*b*.

As indicated in FIGS. 1-3, in one embodiment, the inner surface 55 defines the cavity 65, which receives therein the cable conductors 15. The proximal and distal edges 60*a*, 60*b* respectively define proximal and distal openings 40*a*, 40*b* leading to the cavity 65 and through which the conductors 15 enter the cavity 65. The opposed ends 80*a*, 80*b* generally face each other and are spaced apart from each other to define a gap 85 leading to the cavity 65.

As can be understood from FIGS. 1-3 and FIGS. 4-6 (discussed later in this Detailed Description), in one embodiment, the crimp connector 10 is bi-directional such that the distal and proximal ends (i.e., the ends of the crimp connector 10 having the openings 40*a*, 40*b*) are generally identical in function and appearance. Thus, the crimp connector 10 can be reversed so the proximal end becomes the distal end, or vice versa. As a result, the crimp connector 10 can be installed on the lead 25 with either opening 40*a*, 40*b* facing proximally and receiving therein the cable conductors 15.

As shown in FIGS. 1-3, in one embodiment, the tab 70 projects outwardly from the outer surface 50 on the outward-facing side 30 of the crimp connector 10. In one embodiment, the tab 70 is generally ridge-like and has a rectangle shape that extends uninterrupted along the outer surface 50 in a direction generally transverse to an axis A extending between the proximal and distal openings 40*a*, 40*b*. In other words, as can be understood from FIG. 4, when the crimp connector 10 is mounted on the lead 25, the tab 70 extends along the outer surface 50 in a direction generally transverse to a longitudinal axis L of the lead 25. As shown in FIG. 2, in one embodiment, the tab 70 is stamped into the wall 45 such that a recess 90 is formed in the inner surface 55 of the wall 45.

Figure 5:
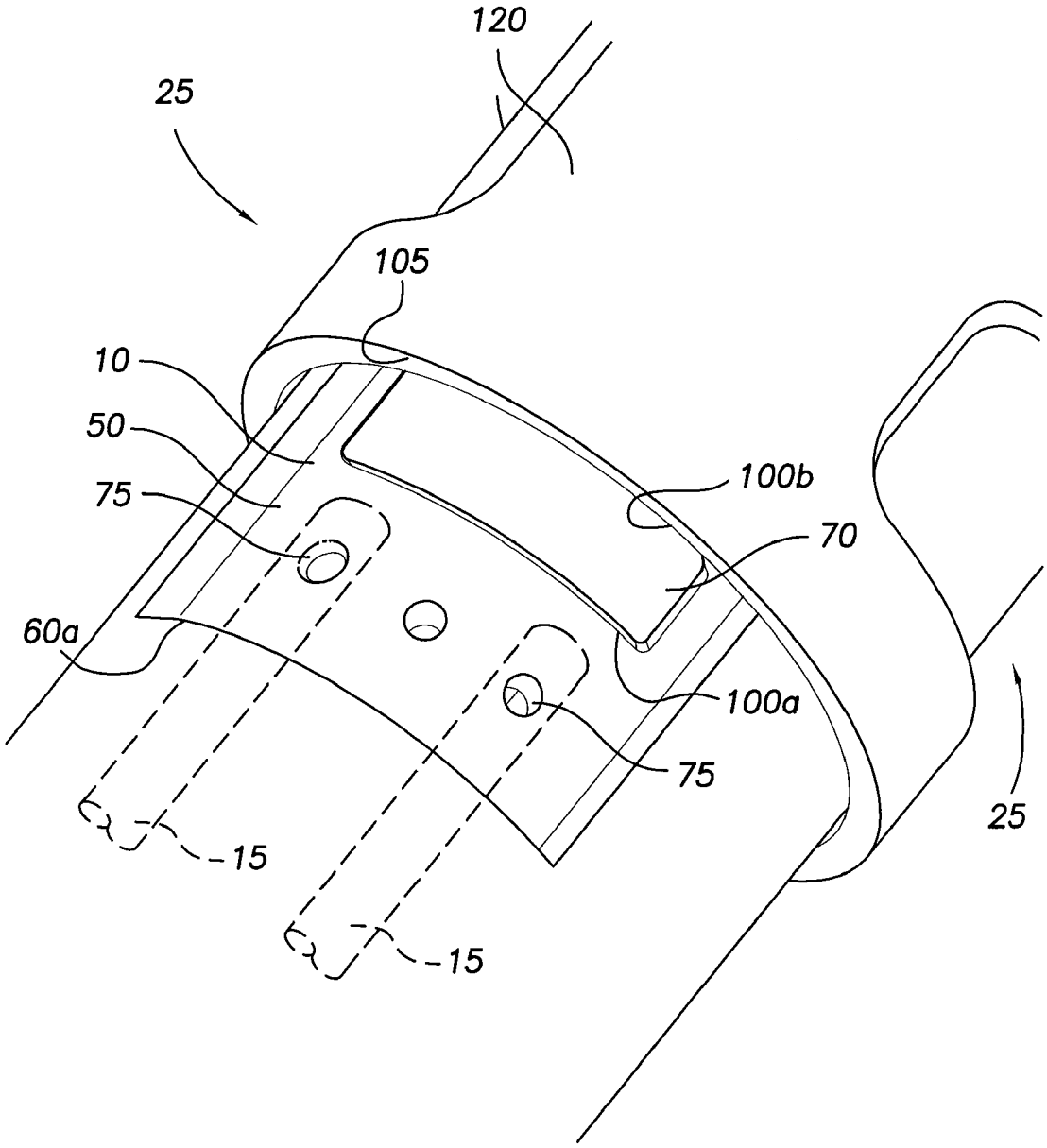
FIG. 5 is an enlarged isometric view of the connector/electrode connection depicted in FIG. 4.
Figure 6:
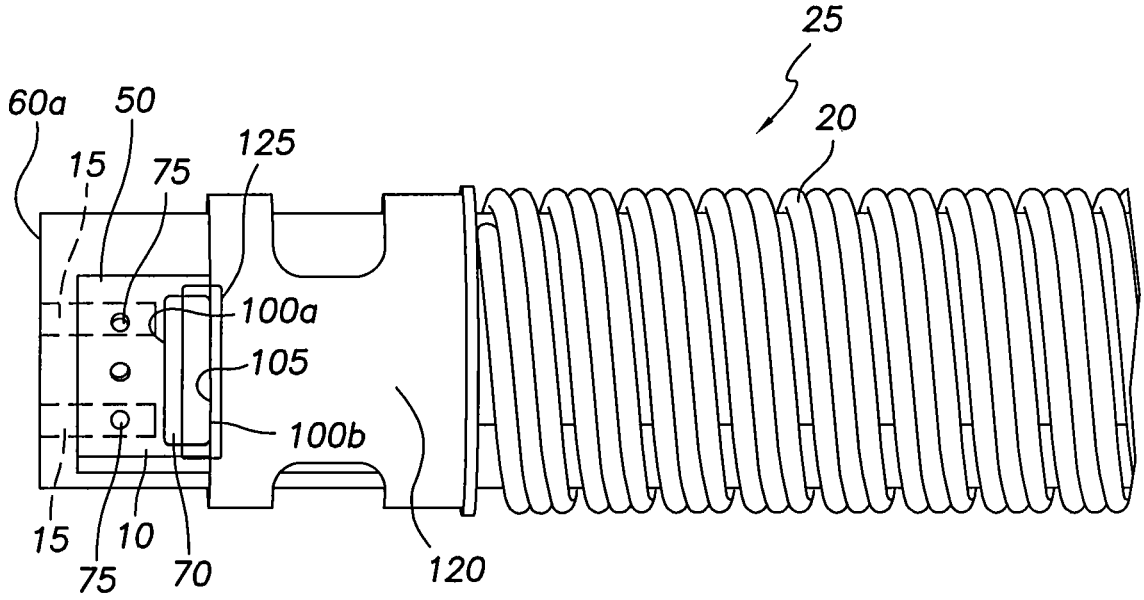
FIG. 6 is a plan view of connector/electrode connection depicted in FIG. 4.

As depicted in FIGS. 1-3, the tab 70 has distal and proximal edges or faces 100*a*, 100*b*. In one embodiment, the faces 100*a*, 100*b* are generally linear or straight. The tab 70 is generally centered distal to proximal on the outer surface 50. As discussed above, the crimp connector 10 is bi-directional. Thus, the crimp connector 10 can be reversed so the proximal end becomes the distal end, or vice versa. As a result, the crimp connector 10 can be installed on the lead 25 with either face 100*a*, 100*b* oriented distally to mate with a welding face 105 of the electrode 20, as depicted in FIGS. 4-6 and discussed later in this Detailed Discussion.

In one embodiment, the tab 70 does not extend in an uninterrupted fashion. Instead, the tab 70 is two or more tabs, bumps, etc. extending in a line transverse to the axis A. The distal and proximal faces 100*a*, 100*b* of each tab 70 transversely align with each other to generally present a common transversely extending face for abutting against and welding to the welding face 105 of the electrode 20.

As illustrated in FIGS. 1-3, in one embodiment, the protrusions 75 extend into the cavity 65 from the inner surface 55 of the wall 45. In one embodiment, each protrusion 75 is a hole formed via a punch or stamping process, resulting in a relatively sharp edge 110 at the inner termination of the protrusion 75. As can be understood from FIG. 3, when the cable conductors 15 are received in the cavity 65 and the crimp connector 10 is crimped onto the cable conductors 15, the cable conductors 15 are forced against the protrusions 75 such that the sharp edges 110 cut through the insulation 13. As a result, the protrusions 75 contact the conductive cores 115 of the cable conductors 15 and form electrical contact between the crimp connector 10 and the cable conductors 15.

Because the protrusions 75 allow the crimp connector 10 to establish electrical contact with the conductor cables 15 without requiring removal of the insulation 13, the insulation 13 need not be ablated or otherwise removed, thereby saving manufacturing time and expense. Additionally, by cutting into the insulation 13, the protrusions 75 assist the crimp connector in securely gripping the cable connectors 15.

In one embodiment, the crimp connector 10 is a generally planar strip or wall 45 formed into a thin-wall body 10 via a stamping process utilizing progressive die tooling. In one embodiment, the wall 45 is formed of a metal or alloy material (e.g., platinum-iridium, MP35N, or stainless steel) and has a sheet thickness of between approximately 0.004 inch and approximately 0.01 inch. In other embodiments, the crimp connector 10 is formed via other manufacturing processes such as metal injection molding or etc.

For a discussion of the crimp connector 10 being employed to connect the cable conductors 15 to an electrode 20, reference is made to FIGS. 4-6. FIG. 4 is an isometric view of a lead 25 with the crimp connector 10 connected to the electrode 20. FIG. 5 is an enlarged isometric view of the connector/electrode connection depicted in FIG. 4. FIG. 6 is a plan view of connector/electrode connection depicted in FIG. 4.

As indicated in FIGS. 4-6, in one embodiment, the electrode or electrode assembly 20 extends about the tubular body of the lead 25 and includes a termination ring 120 at a proximal end of the electrode 20. The proximal edge 105 of the termination ring 120 forms a welding face 105 of the electrode assembly 20. A distal portion of the crimp connector 10 extends underneath the termination ring 120, allowing the distal face 100*b* of the tab 70 to be immediately adjacent to, if not abut against, the welding face 105.

As can be understood from FIGS. 1-6, the wall 45 on the outward-facing side 30 of the crimp connector 10 is arcuate to generally mate with the arcuate shape of the termination ring 120. Similarly, the tab 70 is arcuate such that the faces 100 of the tab 70 mate with the arcuate shape of the face 105 of the termination ring 120. The inward-facing side 35 of the crimp connector 10 is generally more flat or planar than the outward-facing side 30 of the crimp connector 10.

As can be understood from FIG. 6, in one embodiment, the immediately adjacent, transversely extending faces 100*b*, 105 generally match and are welded together via laser welding in the area enclosed by the cloud 125. In other embodiments, other forms of welding are utilized to join the faces 100*b*, 105, including resistance welding or etc. In one embodiment, a series of spot welds (e.g., five spot welds) joins the faces 100*b*, 105 in area 125. In another embodiment, the weld formed in area 125 is generally continuous. Regardless of whether the faces 100*b*, 105 are joined via a series of spot welds or a continuous weld, the welded area

125 is strong due to the relatively extensive length of the welded area 125 made possible by the length over which the faces 100*b*, 105 extend adjacent to each other.

As illustrated in FIGS. 3-6, the cable conductors 15 (shown in phantom line) extend through the tubular body of the lead 25 and into the cavity 65 via the proximal opening 40*a* (see FIGS. 1 and 2) defined by the proximal edge 60*a*. As shown in FIG. 3 and as can be understood from FIGS. 4-6, the crimp connector 10 is crimped onto the cable conductors 15 such that the protrusions 75 cut through the insulation 13 of the cable conductors 15, establishing electrical contact with the conductive cores 115 of the cable conductors 15 and securing the cable conductors 15 in the crimp connector 10. As a result, the cable conductors 15 are electrically coupled to the electrode 20 via the crimp connector 10 welded to the electrode 20.

As can be understood from FIGS. 1-6, the bi-directional configuration of the crimp connector 10 allows either end of the crimp connector 10 to extend under the termination ring 120 as a face 100*a*, 100*b* of the tab 70 forms a butt joint with the face 105 of the termination ring 120. Similarly, the bi-directional configuration of the crimp connector 10 allows either opening 40*a*, 40*b* to receive the cable conductors 15 as the cable conductors 15 enter into the cavity 65.

The butt joint formed between the faces 100, 105 results in a strong welded area 125 and reduces the likelihood of excessive or non-uniform gaps, which cause welding issues like burn-through or poor weld strength. The bi-directional configuration of the crimp connector 10 means there is no reversed or incorrect assembly direction for the crimp connector, thereby eliminating the scrap issues associated with installing a crimp connector in a reversed state. The crimp-through configuration of the crimp connector 10 allows the crimp connector 10 to electrically couple with the conductor cables 15 without the removal of the insulation 13, reducing the costs associated with manufacturing the lead 25 and resulting in a secure connection between the crimp connector 10 and the conductor cables 15.

Although the present invention has been described with reference to preferred embodiments, persons skilled in the art will recognize that changes may be made in form and detail without departing from the spirit and scope of the invention.

What is claimed is:

1. An implantable cardiac electrotherapy lead comprising:

a tubular body;

an electrode on the tubular body and having a termination member at a proximal portion of the electrode;

a cable conductor having a conductive core, an insulation layer, and an end;

a crimp connector electrically coupling the cable conductor to the electrode, the crimp connector comprising:

a thin-walled body having an outer surface, an inner surface, proximal and distal edges, a cavity, a tab, and a protrusion;

wherein the inner surface defines the cavity;

wherein the cavity receives and is crimped onto the end of the cable conductor, the protrusion extending into the cavity and through the insulation layer of the cable conductor to electrically contact the conductive core of the cable conductor;

wherein the proximal and distal edges respectively define proximal and distal openings leading to the cavity;

wherein the tab projects radially outwardly from and extends along the outer surface in a direction generally transverse to an axis extending between the proximal and distal openings; and wherein the tab abuts against and is welded to the termination member of the electrode.

2. The connector of claim 1, wherein the at least one cable conductor enters the cavity via the proximal opening.

3. The connector of claim 1, wherein the tab is generally rectangular.

4. The connector of claim 1, wherein the thin-walled body further includes first and second opposed edges defining a gap leading into the cavity.

5. The connector of claim 1, further comprising at least one protrusion extending into the cavity from the inner surface.

6. The connector of claim 5, wherein the at least one protrusion includes an edge.

7. The connector of claim 5, wherein the protrusion is formed by piercing a hole in the thin-walled body.

8. The connector of claim 1, wherein the connector is manufactured via a stamping process utilizing progressive die tooling.

9. An implantable cardiac electrotherapy lead comprising:

a tubular body;

an electrode on the tubular body and including a termination member at a proximal portion of the electrode;

a cable conductor having a conductor core, an insulation layer, and an end; and a crimp connector electrically coupling the cable conductor to the electrode, the crimp connector including a tab and a cavity, the tab extending radially outwardly from the crimp connector and the cavity receiving the end of the cable conductor, wherein the tab abuts against and is welded to the feature termination member of the electrode.

10. The lead of claim 9, wherein the tab extends generally transverse to the longitudinal axis of the tubular body.

11. The lead of claim 9, wherein the crimp connector further includes a protrusion extending into the cavity and through the insulation layer of the cable conductor to electrically contact the conductive core of the cable conductor.

* * * * *